United States Patent [19]

Bedell

[11] 4,265,665

[45] May 5, 1981

[54] FOUNDRY MOLDS CONTAINING GLASSY METAL ALLOY FILAMENTS

[75] Inventor: John R. Bedell, Madison, N.J.

[73] Assignee: Allied Chemical Corporation, Morris Township, Morris County, N.J.

[21] Appl. No.: 80,372

[22] Filed: Oct. 1, 1979

[51] Int. Cl.[3] ..... B28B 7/28

[52] U.S. Cl. ..... 106/38.9; 106/38.3; 106/38.4; 106/38.7; 106/38.8; 164/349; 164/369

[58] Field of Search ..... 106/38.9, 38.7; 164/349, 369

[56] References Cited

U.S. PATENT DOCUMENTS

| | | | |
|---|---|---|---|
| 1,758,488 | 5/1930 | Weil | 106/38.9 |
| 3,259,947 | 7/1966 | Knight | 106/38.9 |
| 3,856,513 | 12/1974 | Chen et al. | 75/122 |
| 3,862,658 | 1/1975 | Bedell | 164/87 |
| 3,920,605 | 11/1975 | Sato et al. | 260/42.17 |
| 3,960,200 | 6/1976 | Kavesh | 164/281 |
| 4,067,732 | 1/1978 | Ray | 75/122 |
| 4,142,571 | 3/1979 | Narasimhan | 164/88 |

OTHER PUBLICATIONS

J. J. Gilman, "Metalic Glasses", Physics Today, 28 46 (1975).

*Primary Examiner*—Lorenzo B. Hayes
*Attorney, Agent, or Firm*—Gerhard H. Fuchs; James Riesenfeld

[57] ABSTRACT

Foundry sand molds and cores are provided which incorporate glassy metal reinforcing filaments. Molds prepared from the sand composition of this invention provide greater strength before and during metal casting. As the casting solidifies, the temperature of the reinforcing filaments rises, the filaments devitrify and become weak and the mold can be crumbled for easy removal of the casting.

12 Claims, No Drawings

FOUNDRY MOLDS CONTAINING GLASSY METAL ALLOY FILAMENTS

BACKGROUND OF THE INVENTION

1. Field of the Invention

This invention relates to compositions for foundry molds and cores; more particularly, to compositions which include glassy metal alloy reinforcement.

2. Background of the Invention

Metal casting, or founding, is a process for producing metal objects by pouring molten metal into a mold which has a cavity of the desired shape and allowing the metal to solidify. If openings or cavities are to be formed in the casting, a core is inserted into the mold before the metal is introduced. In this specification and the appended claims, the term "molds" is intended to include cores as well.

Molds require strength during casting to support molten metal. However, at some time after a solidified skin has formed on the casting, it is desirable that the mold break easily to permit the casting to be removed without forming hot tears or other defects in the casting. Removal of the casting from the mold is called "shakeout."

Although a variety of materials is used in making foundry molds, by far the most common is sand, since it is relatively inexpensive and is sufficiently refractory for most metal castings. Molding sands may be divided into "soft sands," which remain plastic throughout the mold-making process, and "hard sands," which are more rigid and stronger than soft sands. Compressive and tensile strengths of hard sands may be as high as 25 $kg/cm^2$ and 15 $kg/cm^2$, respectively.

Various binders, both organic and inorganic, provide to hard sands their strength and rigidity. Organic binders include oils, such as linseed, crude esters and polymers, refined esters and polymers, and soybean; cereals, such as finely ground corn, wheat or rye flour, frequently gelatinized; resins, such as ureaformaldehyde, resole and novolac; protein and pitch. The most common inorganic binders are cement and $CO_2$-hardened sodium silicate.

Although soft sands generally can be recycled, hard sands typically are discarded after one use, since residues of cured binder create clumps and fines which interfere with fluidity and gas permeability of the sand composition. Recycling thus requires separating the sand from the other materials and completely replacing the binder. Additional disadvantages of hard sands are high binder costs and, in some cases, reaction between the mold and metal. It is desirable to have molds which provide higher strength with less binder and with recycle capability.

One technique which has been used to strengthen a variety of materials is that of fiber reinforcement, a subject on which much information has been published (see for example *Fiber-Reinforced Materials Technology*, N. J. Parratt, Van Nostrand Reinhold, London, 1972). A matrix may be strengthened by introducing strong fibers in such a way that the matrix transfers stress from fiber to fiber evenly distributing applied loads and reducing the crack propagation tendency of the homogeneous brittle solid. In general, greater strength is imparted to the matrix by longer reinforcing fibers, particularly when the fibers are in parallel alignment.

SUMMARY OF THE INVENTION

The term "filament" as used in this specification and the appended claims is intended to mean an object, such as a wire or fiber, having one dimension very much larger than either of the other two dimensions.

In accordance with the present invention, an improved composition for foundry molds is provided including an admixture of sand and a binder wherein the improvement comprises glassy metal alloy reinforcing filaments dispersed in said admixture. In an alternative embodiment, an improved foundry mold is provided including sand and a binder, wherein the improvement comprises a continuous glassy metal alloy filament surrounding said mold. Glassy metal alloy filaments provide high strength to the mold before and during casting. After casting and while the metal is cooling, the glassy metal alloy filaments heat up and weaken, allowing the mold to crumble without distorting the casting. Thus, improved shakeout properties result.

The glassy metal alloy filaments are preferably ferromagnetic, permitting simple magnetic separation of the filaments from the remainder of the mold materials after shakeout. Thereafter, mold materials may be reclaimed.

The present invention finds advantages in sand, investment and shell casting in any application wherein a mold with high initial strength followed by loss of strength and ductility upon heating is desired.

DETAILED DESCRIPTION OF THE INVENTION

In the preferred embodiment of this invention, a conventional foundry mold composition comprising sand and a binder is improved by incorporating in the composition reinforcing filaments of a glassy metal alloy. In an alternative embodiment, a continuous glassy metal alloy filament surrounds and strengthens a conventional foundry mold.

Incorporating glassy metal alloy filaments into a sand composition provides additional strength to a mold prepared from that composition. Althernatively, adding the filaments permits a reduction in binder percentage without reduction in mold strength. Reducing the binder percentage makes recycle of the materials more feasible. Since the tensile strength of the filaments would be typically of the order of 15 000 $kg/cm^2$ or higher and that of the binder of the order of 150 $kg/cm^2$, filaments can be substituted for binder (within the limits indicated) roughly in the ratio 1:100 without sacrificing mold strength. If binder percentage remains the same, the addition of reinforcing filaments permits a reduction in mold wall thickness, which in turn facilitates venting of gases. Thinner molds also permit more rapid solidification and lower handling costs.

While providing greater strength when it is needed, before and during casting, the present invention also provides better shakeout properties after the metal has hardened and mold collapsibility is desired. As the molten metal hardens, it transfers heat to the mold. The temperature of the filaments rises above the glass transition temperature, $T_g$, thus devitrifying and weakening the filaments in the mold, allowing the mold to crumble and the metal casting to be removed.

$T_g$ of the glassy metal alloy is generally in the range of 350°–550° C. depending on its composition. Preferably, molds are prepared from the composition of this invention in such a way that the reinforcing filaments are heated above $T_g$ at about that time in the casting process when it is desirable to weaken the mold. That result is achieved for casting of a particular metal by suitably choosing mold thickness and geometry. During the casting process there is of course a thermal gradient in the mold, and reinforcing filaments of a particular glassy metal alloy thus would not all weaken at the same time. Although the delay between the time when filaments closer to and further from the cooling metal weaken is generally no problem, the delay can be reduced by providing a heterogeneous mold composition, with filaments nearer the metal having higher $T_g$. In this way, it is even possible, if desired, to have the mold first weaken on the outside, away from the metal, before it weakens on the inside, nearer the metal.

This invention may also be practiced with a long continuous glassy metal filament surrounding and strengthening a conventional—and otherwise weak—mold or core. In that embodiment, when the filament's temperature rises to $T_g$, it falls apart or is easily removed.

In the preferred embodiment of this invention, the glassy metal reinforcing filaments are ferromagnetic. If necessary, then, after the mold has been used, the mold material and filaments can be comminuted and the filaments can be separated magnetically from the other constituents. The materials can then be used again. Useful metal alloy compositions for the filaments comprise about 35 to 85 atom percent iron, 0 to about 60 atom percent nickel, 0 to about 25 atom percent phosphorus, 0 to about 25 atom percent boron, 0 to about 15 atom percent carbon, 0 to about 5 atom percent molybdenum, 0 to about 5 atom percent aluminum and 0 to about 15 atom percent silicon. The main criteria for selecting a ferromagnetic alloy composition for the filaments are low cost and high strength. Elements such as cobalt, vanadium and chromium can be substituted up to about 50% for iron in the alloy compositions; however, their high cost makes them less preferred. Similarly, lower cost makes iron preferably to nickel. Boron, although expensive, is included in most preferred alloys to provide desirable strength. Suitable alloys have compositions in the range $Fe_{35-45}Ni_{35-45}P_{12-16}B_{4-8}$
$Fe_{35-45}Ni_{35-45}B_{15-25}$
$Fe_{35-45}Ni_{35-45}B_{15-25}Mo_{3-5}$
$Fe_{70-80}P_{10-20}C_{0-15}Al_{2-5}Si_{0-2}$
$Fe_{75-85}B_{8-15}C_{0-5}Si_{0-12}$
$Fe_{75-85}B_{8-12}Si_{5-15}$
$Fe_{75-85}B_{15-25}$
$Fe_{75-85}P_{15-25}$ Specific examples include $Fe_{40}Ni_{40}P_{14}B_6$, $Fe_{40}Ni_{40}B_{20}$, $Fe_{40}Ni_{38}B_{18}Mo_4$, $Fe_{76}P_{15}C_5Al_3Si_1$, $Fe_{81}B_{13.5}C_2Si_{3.5}$, $Fe_{80}B_{10}Si_{10}$, $Fe_{80}B_{20}$ and $Fe_{80}P_{20}$. These alloys may be prepared by methods and apparatus described in U.S. Pat. No. 3,856,513, issued Dec. 24, 1974 to Chen and Polk; U.S. Pat. No. 3,862,658, issued Jan. 28, 1975 to Bedell; U.S. Pat. No. 3,960,200, issued June 1, 1976 to Kavesh; U.S. Pat. No. 4,067,732, issued Jan. 10, 1978 to Ray; and U.S. Pat. No. 4,142,571, issued Mar. 6, 1979 to Narasimhan.

For reinforcing filaments dispersed in a sand composition, the glassy metal alloy is first prepared in wire form. Generally, the wire has either circular cross section with diameter in a range of about 12 to 130 μm or non-circular (e.g. square or rectangular) cross section with similar cross-sectional area. In the preferred embodiment, reinforcing filaments cut from the wire have an aspect ratio which involves a compromise between high strength—which dictates high ratio—and good flow properties for the sand composition—which dictates low ratio. The preferred filament aspect ratio is in the range from about 5 to 300, with the range from 25 to 150 more preferred.

In a preferred embodiment of this invention, a composition for foundry molds and cores is provided which comprises an admixture of about 90.0 to 99.5% by weight of sand, about 0.1 to 9.8% by weight of binder and about 0.2 to 9.9% by weight of glassy metal alloy reinforcing filaments. In a more preferred composition, the reinforcing filaments comprise about 1 to 3% by weight of the composition.

In the embodiment wherein a continuous glassy metal filament surrounds and strengthens a conventional mold, a ribbon-shaped filament is suitable. For small molds, the filament width is preferably less than 3 mm, so that it doesn't hang up on irregularities on the mold's surface. Filament thicknesses less than 0.5 mm are preferred. For larger molds, filaments up to 10 mm wide or wider are suitable, with correspondingly greater thickness. The continuous wrap need not cover the entire outer surface of the mold, but it may. If desirable, the continuous wrap can form multiple layers. The ends of the wrap may be adhered to an adjoining filament layer either by an adhesive, such as epoxy, that can withstand any subsequent mold-curing step which may be necessary, or by spot welding. Alternatively, the ends may be mechanically anchored. For safety purposes, it may be desirable to provide a shroud surrounding the wrapped mold to contain the wrap in the event of an inadvertent break in the filaments, which might otherwise cause the wrap suddenly to spring away from the mold.

The following examples are presented in order to provide a more complete understanding of the invention. The specific techniques, conditions, materials and reported data set forth to illustrate the principles and practice of the invention are exemplary and should not be construed as limiting the scope of the invention.

EXAMPLE 1

A molding mixture of 98 weight percent silica sand and 2 weight percent linseed oil is prepared for evaluations of mold structure capabilities with and without glassy metal filament additions. A second mixture is formed by adding to a portion of this molding mixture 1 weight percent of glassy metal filaments 0.038 mm thick by 0.5 mm wide by 5 mm long and composed of 81 atom percent iron, 13.5 atom percent boron, 2 atom percent carbon and 3.5 atom percent silicon. Three hollow, substantially cylindrical molds, 51 mm I.D.×76 mm O.D.×305 mm inside height×330 mm outside height, are prepared and rammed from each mixture. The six molds are baked in air at 200° C. for 2 hours to cure the oil binder.

Cast iron at 2600° C. is then cast into each unsupported, upright mold. Mold rupture and breakout of molten metal upon filling occurs approximately 50 to 100 mm above the bottom of the three (prior art) molds made from the mixture that does not contain the glassy metal filaments. The reinforced molds, which incorporate the filaments, contain the metal without breakout. These molds subsequently fall away, leaving the solidified cast iron cylinders intact.

After the cast, the remnants of the reinforced molds are gathered up and mulled to break them up thoroughly. The metallic filaments are then separated from the mold fragments by passing a permanent magnet over and through the fragments. Many of the separated filaments are much shorter than the original average filament length, and all of the separated filaments are much more brittle and weaker than before casting, which explains why the reinforced molds ultimately fail.

Prior art molds of 89 mm, 102 mm and 114 mm O.D. are prepared from the sand-linseed oil mix that does not contain the glassy metal filaments. These molds are of the same I.D., inside height, and outside height as the first set of molds. Cast iron at 2600° C. is again cast into the unsupported, upright molds. Breakout occurs in all the 89 mm O.D. molds, and no breakout occurs in the molds of greater wall thicknesses. Fumes produced from these molds, each mold having a greater volume of sand mix than the first set, are considerably greater than the fumes generated when metal is cast into the first set of molds.

The ratio of sand volume between the reinforced molds (76 mm O.D.) and the smallest prior art molds (102 mm O.D.) that are able to produce an undamaged casting is 0.43. Thus, over a 50% savings in sand and binder may be realized, with the corresponding advantages that were discussed above.

EXAMPLE 2

Using the silica sand-linseed oil molding mixture of Example 1 without glassy metal filaments, three hollow, substantially cylindrical molds, 51 mm I.D.×70 mm O.D.×305 mm inside height×330 mm outside height, are prepared and rammed. The molds are retracted from the pattern, leaving unretracted from each mold the pattern pieces for the internal mold cavity. This center piece provides support for the thin-walled mold during subsequent handling.

The entire external cylindrical face of each mold is wound with a single layer of continuous monofilament of glassy metal 0.038 mm thick, 1.8 mm wide, and composed of 81 atom percent iron, 13.5 atom percent boron, 2 atom percent carbon and 3.5 atom percent silicon. The monofilament is wound on a pitch of approximately 2.5 mm per turn to provide a weight of filament which is approximately 1% of the mold weight. To prevent unwinding, both ends of the filament are secured by adhering them to their nearest adjacent windings with a rapid curing epoxy.

The inner pattern is then removed from each of the three molds, and the molds are baked in air at 200° C. for two hours to cure the oil binder.

Cast iron at 2600° C. is then cast into each unsupported, upright mold. No mold rupture occurs in any of the three wrapped molds. About two minutes after casting, the monofilament wrapping begins to break rapidly at several points, springing open and allowing the mold mix, which is no longer contained, to collapse away from the solidified cast iron cylinders. The fuming from casting into each of these three molds is less than that produced when casting into any of the other molds described, which demonstrates an advantage of the thin-walled mold.

After the cast, the remnants of the molds and filament are gathered up and mulled to break up the remnants thoroughly. The metallic filament material is then separated from the mold fragments by passing a permanent magnet over and through the fragments. The broken filament segments are much more brittle and weaker than before casting, which explains why the mold ultimately fails.

The ratio of sand volume between the monofilament-wrapped molds (70 mm O.D.) and the smallest non-filament molds (102 mm - Example 1) that are able to produce an undamaged casting is 0.32. Thus, only about $\frac{1}{3}$ of the sand-binder mixture used in molds of the prior art is needed, with corresponding advantages that were described above.

I claim:

1. In a foundry mold containing an admixture of sand and a binder, the improvement comprising about 0.2 to 9.9 percent by weight of glassy metal alloy reinforcing filaments dispersed in said admixture, said filaments having an aspect ratio in the range of 5 to 300 and having a composition selected from the group consisting of:

(a) about 35 to 45 atom percent iron, about 35 to 45 atom percent nickel, about 12 to 16 atom percent phosphorus, and about 4 to 8 atom percent boron;

(b) about 35 to 45 atom percent iron, about 35 to 45 atom percent nickel, and about 15 to 25 atom percent boron;

(c) about 35 to 45 atom percent iron, about 35 to 45 atom percent nickel, about 15 to 25 atom percent boron and about 3 to 5 atom percent molybdenum;

(d) about 70 to 80 atom percent iron, about 10 to 20 atom percent phosphorus, 0 to about 15 atom percent carbon, about 2 to 5 atom percent aluminum, and 0 to about 2 atom percent silicon;

(e) about 75 to 85 atom percent iron, about 8 to 15 atom percent boron, 0 to about 5 atom percent carbon, and 0 to about 12 atom percent silicon;

(f) about 75 to 85 atom percent iron, about 8 to 12 atom percent boron, and about 5 to 15 atom percent silicon;

(g) about 75 to 85 atom percent iron, and about 15 to 25 atom percent boron; and (h) about 75 to 85 atom percent iron, and about 15 to 25 atom percent phosphorus.

2. The mold of clam 1 wherein said reinforcing filaments comprise about 1 to 3 percent by weight of said composition.

3. The mold of claim 1 wherein said reinforcing filaments have an aspect ratio in the range from about 25 to 150.

4. The mold of claim 1 wherein said glassy metal alloy is about 35 to 45 atom percent iron, about 35 to 45 atom percent nickel, about 12 to 16 atom percent phosphorus and about 4 to 8 atom percent boron.

5. The mold of claim 1 wherein said glassy metal alloy is about 35 to 45 atom percent iron, about 35 to 45 atom percent nickel and about 15 to 25 atom percent boron.

6. The mold of claim 1 wherein said glassy metal alloy is about 35 to 45 atom percent iron, about 35 to 45 atom percent nickel, about 15 to 25 atom percent boron and about 3 to 5 atom percent molybdenum.

7. The mold of claim 1 wherein said glassy metal alloy is about 70 to 80 atom percent iron, about 10 to 20 atom percent phosphorus, 0 to about 15 atom percent carbon, about 2 to 5 atom percent aluminum and 0 to about 2 atom percent silicon.

8. The mold of claim 1 wherein said glassy metal alloy is about 75 to 85 atom percent iron, about 8 to 15 atom percent boron, 0 to about 5 atom percent carbon and 0 to about 12 atom percent silicon.

9. The mold of claim 1 wherein said glassy metal alloy is about 75 to 85 atom percent iron, about 8 to 12 atom percent boron and about 5 to 15 atom percent silicon.

10. The mold of claim 1 wherein said glassy metal alloy is about 75 to 85 atom percent iron and about 15 to 25 atom percent boron.

11. The mold of claim 1 wherein said glassy metal alloy is about 75 to 85 atom percent iron and about 15 to 25 atom percent phosphorus.

12. In a foundry mold containing sand and a binder, the improvement comprising a continuous strand of glassy metal alloy filament would around the external surface of said mold.

* * * * *

UNITED STATES PATENT AND TRADEMARK OFFICE

CERTIFICATE OF CORRECTION

PATENT NO. : 4,265,665

DATED : May 5, 1981

INVENTOR(S) : John R. Bedell

It is certified that error appears in the above-identified patent and that said Letters Patent are hereby corrected as shown below:

IN THE CLAIMS:

Column 8, line 5 (claim 12) "would" should be --wound--

Signed and Sealed this

*Fourth* Day of *August 1981*

[SEAL]

*Attest:*

GERALD J. MOSSINGHOFF

*Attesting Officer*

*Commissioner of Patents and Trademarks*